US005962210A

United States Patent [19]

Hahm et al.

[11] Patent Number: 5,962,210

[45] Date of Patent: Oct. 5, 1999

[54] COLOR PAPER WITH IMPROVED WET ABRASION SENSITIVITY

[75] Inventors: Paul T. Hahm, Hilton; Alberto M. Martinez, Rochester; Melvin M. Kestner, Hilton; Eric L. Bell, Webster; Walter H. Isaac, Penfield, all of N.Y.

[73] Assignee: Eastman Kodak Company, Rochester, N.Y.

[21] Appl. No.: 09/005,861

[22] Filed: Jan. 12, 1998

[51] Int. Cl.[6] ..... G03C 1/09; G03C 1/035; G03C 1/34

[52] U.S. Cl. ..... 430/567; 430/603; 430/605; 430/600; 430/614; 430/611

[58] Field of Search ..... 430/603, 567, 430/605, 600, 614, 611

[56] References Cited

U.S. PATENT DOCUMENTS

| | | | |
|---|---|---|---|
| 3,397,986 | 8/1968 | Millikan et al. | 430/603 |
| 5,360,712 | 11/1994 | Olm et al. | 430/567 |
| 5,418,127 | 5/1995 | Budz et al. | 430/611 |
| 5,462,849 | 10/1995 | Kuromoto et al. | 430/567 |
| 5,474,888 | 12/1995 | Bell | 430/567 |
| 5,523,200 | 6/1996 | Hahm et al. | 430/569 |
| 5,543,281 | 8/1996 | Isaac et al. | 430/551 |
| 5,547,827 | 8/1996 | Chen et al. | 430/567 |
| 5,550,013 | 8/1996 | Chen et al. | 430/567 |
| 5,830,631 | 11/1998 | Hendricks et al. | 430/543 |

FOREIGN PATENT DOCUMENTS

| | | | |
|---|---|---|---|
| 0 244 184 B1 | 12/1993 | European Pat. Off. | G03C 1/06 |
| 0 718 679 A1 | 6/1996 | European Pat. Off. | G03C 1/035 |
| 0 750 222 A2 | 12/1996 | European Pat. Off. | G03C 1/09 |

OTHER PUBLICATIONS

Research Disclosure, Item #37154, Mar. 1995, p. 227.

*Primary Examiner*—Mark F. Huff
*Attorney, Agent, or Firm*—Paul A. Leipold

[57] ABSTRACT

The invention relates to a photographic emulsion comprising silver iodochloride grains, said grains further comprising iridium, said grains chemically sensitized with gold in an amount of between 120 and 200 mg gold per silver mole and sulfur in an amount between 0.1 and 20 mg sulfur per silver mole, 1-(3-acetamidophenyl)-5-mercaptotetrazole, 1-phenyl-5-mercaptotetrazole, and a disulfide compound represented by the following formula:

wherein

X is independently —O—, —NH— or —NR—, where R is a substituent;

m and r are independently 0, 1 or 2;

X is —H or a cationic species;

Ar is an aromatic group; and

L is a linking group, where p is 0 or 1.

33 Claims, No Drawings

COLOR PAPER WITH IMPROVED WET ABRASION SENSITIVITY

FIELD OF THE INVENTION

This invention relates to a photographic color paper. It particularly relates to a color paper utilizing silver iodochloride emulsion and a disulfide compound, mercapto compound, and gold.

BACKGROUND OF THE INVENTION

In forming color photographic prints after exposure the prints need to be processed in developing solutions. During development the gelatin containing the silver halide and color couplers is softened and becomes permeable to aqueous solutions. When the color paper is in the developing solution and immediately after removal from the developing solutions, it may be easily scratched. Such scratches to the surface of the color paper will cause an unacceptable image to be formed on the paper. The scratching of the paper leads to fogging of the silver halide grains that are being developed in the paper. This fogging gives rise to nonimagewise grain development and shows up as defects that are lines on the prints.

There have been efforts in the past to minimize the image distortions caused by wet abrasion. Representative of patents relating to these efforts are EP 244,184, U.S. Pat. No. 5,543,281, and copending and coassigned application U.S. Ser. No. 08/729,127 filed Oct. 11, 1996, now U.S. Pat. No. 5,830,631.

Problem to be Solved by the Invention

There remains a need to provide improved resistance to wet abrasion in color photographic papers.

SUMMARY OF THE INVENTION

An object of the invention is to provide color photographic papers that have improved formation of color images.

A further object is to provide color papers that have improved resistance to wet abrasion defects during processing.

These and other advantages of the invention are generally accomplished by providing a photographic emulsion comprising silver iodochloride grains, said grains further comprising iridium, said grains chemically sensitized with gold in an amount of between 0.1 and 120 mg/Ag mole and sulfur in an amount between 0.1 and 20 mg/Ag mole, 1-(3-acetamidophenyl)-5-mercaptotetrazole, 1-phenyl-5-mercaptotetrazole, and a disulfide compound represented by the following formula:

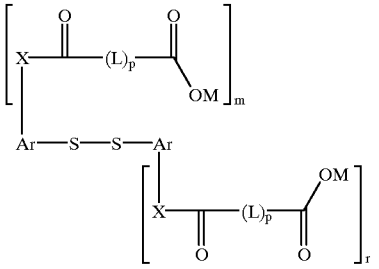

wherein

X is independently —O—, —NH— or —NR—, where R is a substituent;

m and r are independently 0, 1 or 2;

M is —H or a cationic species;

Ar is an aromatic group; and

L is a linking group, where p is 0 or 1.

In a particularly preferred embodiment the emulsion of the invention is utilized in a color photographic paper.

Advantageous Effect of the Invention

The invention provides an improved photographic color paper that has resistance to wet abrasion during processing. The paper has improved image formation as non imagewise development does not result from abrasion of the surface of the paper while it is wet during processing.

DETAILED DESCRIPTION OF THE INVENTION

The invention has numerous advantages over prior color paper materials. The paper provides improved resistance to defects caused by abrasion during processing. The paper may be handled during processing in a manner which allows more rapid processing and is not subject to minor machine variances and defects in paper handling. The paper exhibits improved image formation as the image is true to the negative that has been exposed onto the paper and is not subjected to non image artifacts being introduced during processing. These advantages also are all available without deterioration in photographic speed from prior color print materials. The color paper of the invention also provides improved imaging in low density areas of the color prints as the background fog level is consistently low as developing does not introduce fog into the print.

The 1-(3-acetamidophenyl)-5-mercaptotetrazole useful in the invention is present in an amount between $1.5\times10^{-5}$ and $7.0\times10^{-5}$ mole/silver mole.

The 1-phenyl-5-mercaptotetrazole useful in the invention is present in an amount between 0.01 and 0.7 mg/ft$^2$.

Definition of Terms

The term "high chloride" in referring to silver halide grains and emulsions is employed to indicate an overall chloride concentration of at least 90 mole percent, based on total silver.

In referring to grains and emulsions containing two or more halides, the halides are named in their order of ascending concentrations.

Grains and emulsions referred to as "silver bromochloride" or "silver iodochloride" can, except as otherwise indicated, contain impurity or functionally insignificant levels of the unnamed halide (e.g., less than 1.0 M %, based on total silver).

The term "cubic grain" is employed to indicate a grain that is bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced.

Photographic speed was measured at a density of 0.8. Relative speed is reported in relative log units and therefore referred to as relative log speed. For example, a relative log speed difference of 30 relative log units=0.30 log E, where E is exposure in lux-seconds.

In one aspect this invention is directed to a photographic print element comprised of a reflective support and, coated on the support, at least the magenta light image recording emulsion layer unit contains a radiation-sensitive emulsion comprised of a dispersing medium and silver iodochloride grains wherein the silver iodochloride grains are comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide free surface shell having a thickness of greater than 50 Å, and a sub-surface shell that contains a maximum iodide concentration.

The photographic print elements of the invention are comprised of a reflective support and, coated on the support, at least one radiation-sensitive cubical grain high chloride imaging emulsion. The color paper of the invention may preferably be flash exposed.

Emulsions of the present invention may be used in electronic printing, in which the recording element is scanned by one or more high energy beams to provide a short duration exposure in a pixel-by-pixel mode using a suitable source such as a cathode ray tube (CRT), light emitting diode (LED) or laser. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour,* Fourth Edition, pages 306–307, (1987).

It has been recognized for the first time that heretofore unattained levels of sensitivity and other advantageous properties, such as those recited in the objects and demonstrated in the samples below, can be realized, without offsetting degradation of photographic performance, by the controlled, non-uniformly distributed incorporation of iodide within the grains. Specifically, after at least 50 (preferably 85) percent of total silver forming the grains has been precipitated to form a core portion of the grains, a maximum iodide concentration is located within a shell that is formed on the host (core) grains, and the maximum iodide concentration containing shell is then converted to a sub-surface shell by precipitating silver and chloride ions without further iodide addition.

The silver iodochloride grains show enhanced performance with iodide concentrations ranging from 0.05 to 3.0 mole percent, based on total silver. Preferably overall iodide concentrations range from 0.1 to 1.5 mole percent, based on total silver. More important than the overall iodide concentration within the silver iodochloride grains is the placement of the iodide.

Iodide incorporation in the core portions of the grains adds iodide with no significant enhancement of photoefficiency. To avoid unnecessarily elevating overall iodide levels, it is contemplated that the iodide concentrations in the central (core) portions of the grains in all instances be less than the maximum incorporated iodide concentration. Preferably the iodide concentration in the core portions of the grains is less than half the average overall iodide concentration and, optimally, the core is substantially free of iodide—that is, formed without intentionally adding iodide. In comparing emulsions containing the same overall levels of iodide, speed enhancements are directly related to the extent to which iodide is excluded from the central portions of the grains.

Iodide addition onto the core portions of the grains creates a silver iodochloride shell on the host (core) grains. Attempts to use these shelled grains in photographic print elements without further modification results in markedly inferior performance. Having high iodide concentrations at the surface of the grains lowers speed as compared to the emulsions satisfying the requirements of the invention when both emulsions are sensitized to the same minimum density and otherwise produces elevated levels of minimum density that are incompatible with acceptable performance characteristics of photographic reflective print elements.

To increase speed and lower minimum density an iodide-free shell is precipitated onto the silver iodochloride shell, converting it into a sub-surface shell. The depth to which sub-surface shell is buried is chosen to render the iodide in the sub-surface shell inaccessible to the developing agent at the outset of development of latent image bearing grains and inaccessible throughout development in the grains that do not contain a latent image. The thickness of the surface shell is contemplated to be greater than 50 Å in emulsions employed in reflection print photographic elements. The surface shell thickness can, of course, range up to any level compatible with the minimum core requirement of 50 (preferably 85) percent of total silver. Since the sub-surface shell can contribute as little as 0.05 mole percent iodide, based on total silver, it is apparent that surface shells can account for only slightly less than all of the silver not provided by the core portions of the grains. A surface shell accounting for just less than 50 (preferably just less than 15) percent of total silver is specifically contemplated.

The presence of a maximum iodide concentration in the sub-surface shell is in itself sufficient to increase photographic speed. It has been additionally observed that when further enhancements in photographic speed attributable to iodide incorporation in the sub-surface shell are realized the emulsions exhibit a unique stimulated fluorescent emission spectral profile. Specifically, it has been observed that further enhanced photographic sensitivity is in evidence in emulsions that, when stimulated with 390 nm radiation at 10° K, produce a peak stimulated fluorescent emission in the wavelength range of from 450 to 470 nm that is at least twice the intensity of stimulated fluorescent emission at 500 nm (hereinafter referred to the reference emission wavelength). Emission at 500 nm is attributed to the chloride in the grains. In the absence of iodide (and hence the absence of iodide induced crystal lattice variances) the peak intensity of stimulated fluorescent emission in the wavelength range of from 450 to 470 nm is relatively low, typically less than that at the reference emission wavelength.

To achieve the crystal lattice defects that stimulate a peak fluorescent emission in the wavelength range of from 450 to 470 nm to more than twice the reference wavelength emission, only very low levels of iodide, based on total silver, are required. It is not the overall concentration of iodide that determines the fluorescent emission profile or emulsion sensitivity, but the crystal lattice defects that the iodide, when properly introduced, create. Slow iodide ion introductions that anneal out crystal lattice defects can incorporate iodide ion concentrations in excess of the minimum levels noted above without creating the stimulated emission profiles exhibited by the emulsions of the highest levels of sensitivity. The emulsion preparations of the samples below demonstrate iodide ion incorporations that create the stimulated emission profiles and enhanced levels of sensitivity that represent preferred embodiments of this invention. Parameters that promote enhanced sensitivity are (1) increased localized concentrations of iodide, and/or (2) abrupt introductions of iodide ion during precipitation (sometimes referred to as "dump iodide" addition). When coupled with (1) and/or (2), increased overall iodide concentrations also contribute to achieving higher levels of photoefficiency. Increasing overall iodide concentrations without following the placement requirements of the invention can increase photographic speed, but this produces the disadvantages of elevated iodide ion incorporation that have been reported and avoided in selecting emulsions for photographic reflection print elements.

It is surprising that burying the maximum iodide phase within the grains not only is compatible with achieving higher levels of photoefficiency but actually contributes an additional increment of speed enhancement. Whereas it might be thought that shifting the maximum iodide phase to the interior of the grain would also shift the latent image internally, detailed investigations have revealed that latent image formation remains at the surface of the grains. The invention has resulted from empirical correlations of incorporated structural features and observed performance enhancements, and no theory has been devised that can fully account for performance characteristics observed.

It was initially observed that, after starting with monodisperse silver chloride cubic grains (i.e., grains consisting of six {100} crystal faces), iodide introduction produced tetradecahedral grains (i.e., grains consisting of six {100} crystal faces and eight {111} crystal faces). Further investigations revealed that as few as one {111} crystal face are sometimes present in the completed grains. On still further investigation, it has been observed that the emulsions of the invention can be cubic grain emulsions. Thus, although the presence of at least {111} crystal face (and usually tetradecahedral grains), provides a convenient visual clue that the grains may have been prepared according to the teaching of this invention, it has now been concluded that one or more {111} crystal faces are a by-product of grain formation that can be eliminated or absent without compromising the unexpected performance advantages of the invention noted above.

The preparation of cubical grain silver iodo-chloride emulsions with iodide placements that produce increased photographic sensitivity can be undertaken by employing any convenient conventional high chloride cubical grain precipitation procedure prior to precipitating the region of maximum iodide concentration—that is, through the introduction of at least the first 50 (preferably at least the first 85) percent of silver precipitation. The initially formed high chloride cubical grains then serve as hosts for further grain growth. In one specifically contemplated preferred form the host emulsion is a monodisperse silver chloride cubic grain emulsion. Low levels of iodide and/or bromide, consistent with the overall composition requirements of the grains, can also be tolerated within the host grains. The host grains can include other cubical forms, such as tetradecahedral forms. Techniques for forming emulsions satisfying the host grain requirements of the preparation process are well known in the art. For example, prior to growth of the maximum iodide concentration region of the grains, the precipitation procedures of Atwell U.S. Pat. No. 4,269,927, Tanaka EPO 0 080 905, Hasebe et al U.S. Pat. No. 4,865,962, Asami EPO 0 295 439, Suzumoto et al U.S. Pat. No. 5,252,454 or Ohshima et al U.S. Pat. No. 5,252,456, the disclosures of which are here incorporated by reference, can be employed, but with those portions of the preparation procedures, when present, that place bromide ion at or near the surface of the grains being omitted. Stated another way, the host grains can be prepared employing the precipitation procedures taught by the citations above through the precipitation of the highest chloride concentration regions of the grains they prepare.

Once a host grain population has been prepared accounting for at least 50 percent (preferably at least 85 percent) of total silver has been precipitated, an increased concentration of iodide is introduced into the emulsion to form the region of the grains containing a maximum iodide concentration. The iodide ion is preferably introduced as a soluble salt, such as an ammonium or alkali metal iodide salt. The iodide ion can be introduced concurrently with the addition of silver and/or chloride ion. Alternatively, the iodide ion can be introduced alone followed promptly by silver ion introduction with or without further chloride ion introduction. It is preferred to grow the maximum iodide concentration region on the surface of the host grains rather than to introduce a maximum iodide concentration region exclusively by displacing chloride ion adjacent the surfaces of the host grains.

To maximize the localization of crystal lattice variances produced by iodide incorporation it is preferred that the iodide ion be introduced as rapidly as possible. That is, the iodide ion forming the maximum iodide concentration region of the grains is preferably introduced in less than 30 seconds, optimally in less than 10 seconds. When the iodide is introduced more slowly, somewhat higher amounts of iodide (but still within the ranges set out above) are required to achieve speed increases equal to those obtained by more rapid iodide introduction and minimum density levels are somewhat higher. Slower iodide additions are manipulatively simpler to accomplish, particularly in larger batch size emulsion preparations. Hence, adding iodide over a period of at least 1 minute (preferably at least 2 minutes) and, preferably, during the concurrent introduction of silver is specifically contemplated.

It has been observed that when iodide is added more slowly, preferably over a span of at least 1 minute (preferably at least 2 minutes) and in a concentration of greater than 5 mole percent, based on the concentration of silver concurrently added, the advantage can be realized of decreasing grain-to-grain variances in the emulsion. For example, well defined tetradecahedral grains have been prepared when iodide is introduced more slowly and maintained above the stated concentration level. It is believed that at concentrations of greater than 5 mole percent the iodide is acting to promote the emergence of {111} crystal faces. Any local iodide concentration level can be employed up to the saturation level of iodide in silver chloride, typically about 13 mole percent. Maskasky U.S. Pat. No. 5,288,603, here incorporated by reference, discusses iodide saturation levels in silver chloride.

Further grain growth following precipitation of the maximum iodide concentration region can be undertaken by any convenient conventional technique. Conventional double-jet introductions of soluble silver and chloride salts can precipitate silver chloride as a surface shell. Alternatively, particularly where a relatively thin surface shell is contemplated, a soluble silver salt can be introduced alone, with additional chloride ion being provided by the dispersing medium.

At the conclusion of grain precipitation the grains can take varied cubical forms, ranging from cubic grains (bounded entirely by six {100} crystal faces), grains having an occasional identifiable {111} face in addition to six {100} crystal faces, and, at the opposite extreme tetradecahedral grains having six {100} and eight {111} crystal faces.

After examining the performance of emulsions exhibiting varied cubical grain shapes, it has been concluded that the performance of these emulsions is principally determined by iodide incorporation and the uniformity of grain size dispersity. The silver iodochloride grains are relatively monodisperse. The silver iodochloride grains preferably exhibit a grain size coefficient of variation of less than 35 percent and optimally less than 25 percent. Much lower grain size coefficients of variation can be realized, but progressively smaller incremental advantages are realized as dispersity is minimized.

In a preferred form of the invention it is specifically contemplated to incorporate in the face centered cubic crystal lattice of the grains iridium dopants capable of increasing photographic speed.

The following are specific illustrations of dopants capable of use in the invention:

$K_2IrCl_5$ (5-methylthiazole)

$K_2IrBr_5$ (thiazole)

$K_2IrBr_4$ (thiazole)$_2$ and $K_2IrCl_5$ (thiazole)

The dopants are effective at any location within the grains. Generally better results are obtained when the dopant is incorporated in the exterior 50 percent of the grain, based on silver. To insure that the dopant is in fact incorporated in the grain structure and not merely associated with the surface of the grain, it is possible to introduce the dopant prior to forming, during or after forming the maximum iodide concentration region of the grain. Thus, an optimum grain region for dopant incorporation is that formed by silver ranging from 50 to 100 percent of total silver forming the grains. That is, dopant introduction is optimally commenced after 50 percent of total silver has been introduced. The dopant can be introduced all at once or run into the reaction vessel over a period of time while grain precipitation is continuing.

The iridium dopants are generally used in an amount between $1\times10^{-10}$ and $1\times10^{-5}$ moles per silver mole. A preferred amount of the iridium is between $1\times10^{-9}$ and $1\times10^{-6}$ moles per silver mole for best photographic performance.

The contrast of photographic elements containing silver iodochloride emulsions of the invention can be further increased by doping the silver iodochloride grains with a hexacoordination complex containing a nitrosyl or thionitrosyl ligand. Preferred coordination complexes of this type are represented by the formula:

$$[TE_4(NZ)E']^r \quad \text{(III)}$$

where

T is a Os or Ru;

E is a bridging ligand;

E' is E or NZ;

r is zero, -1, -2 or -3; and

Z is oxygen or sulfur.

Osmium and ruthenium dopants such as in copending and coassigned U.S. Pat. No. 5,830,631 hereby incorporated by reference may also be used in the emulsions of the invention.

The E ligands can take any of the forms found in the dopants. A listing of suitable coordination complexes satisfying formula III is found in McDugle et al U.S. Pat. No. 4,933,272, the disclosure of which is here incorporated by reference.

After precipitation and before chemical sensitization the emulsions can be washed by any convenient conventional technique. Conventional washing techniques are disclosed by *Research Disclosure,* Item 36544, cited above, Section III. Emulsion washing.

The emulsions can be prepared in any mean grain size known to be useful in photographic print elements. Mean grain sizes in the range of from 0.15 to 2.5 $\mu$m are typical, with mean grain sizes in the range of from 0.2 to 2.0 $\mu$m being generally preferred.

The gold and sulfur chemical sensitizers of the invention may be any suitable known type. Typical of suitable gold and sulfur sensitizers are those set forth in Section IV of *Research Disclosure* 38957, September 1996. Preferred is colloid aurous sulfide such as disclosed in *Research Disclosure* 37154 for good speed and low fog.

During emulsion finishing it is possible to add dopants. It is preferred in the invention that iridium complex be added during finishing in order to produce a print material with good reciprocity performance. The iridium complex is a compound such as those listed above and is added in an amount between $1\times10^{-10}$ and $1\times10^{-5}$ mg/silver mole. A preferred amount is between $1\times10^{-9}$ and $1\times10^{-6}$ mg/silver mole for best photographic performance.

The emulsions can be spectrally sensitized in any convenient conventional manner. Spectral sensitization and the selection of spectral sensitizing dyes is disclosed, for example, in *Research Disclosure,* Item 36544, cited above, Section V. Spectral sensitization and desensitization.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering,* Vol. 18, 1974, pp. 418–430.

The silver iodochloride emulsions are preferably protected against changes in fog upon aging. Preferred antifoggants can be selected from among the following groups:

A. A mercapto heterocyclic nitrogen compound containing a mercapto group bonded to a carbon atom which is linked to an adjacent nitrogen atom in a heterocyclic ring system, B. A quaternary aromatic chalcogenazolium salt wherein the chalcogen is sulfur, selenium or tellurium, C. A triazole or tetrazole containing an ionizable hydrogen bonded to a nitrogen atom in a heterocyclic ring system, or D. A dichalcogenide compound comprising an —X—X— linkage between carbon atoms wherein each X is divalent sulfur, selenium or tellurium.

It is, of course, recognized that the photographic elements of the invention can include more than one emulsion. Where more than one emulsion is employed, such as in a photographic element containing a blended emulsion layer or separate emulsion layer units, all of the emulsions can be silver iodochloride emulsions as contemplated by this invention. Alternatively one or more conventional emulsions can be employed in combination with the silver iodochloride emulsions of this invention. For example, a separate emulsion, such as a silver chloride or bromochloride emulsion, can be blended with a silver iodochloride emulsion according to the invention to satisfy specific imaging requirements. For example, emulsions of differing speed are conventionally blended to attain specific aim photographic characteristics. Instead of blending emulsions, the same effect can usually be obtained by coating the emulsions that might be blended in separate layers. It is well known in the art that increased photographic speed can be realized when faster and slower emulsions are coated in separate layers with the faster emulsion layer positioned to receiving exposing radiation first. When the slower emulsion layer is coated to receive exposing radiation first, the result is a higher contrast image. Specific illustrations are provided by *Research Disclosure,* Item 36544, cited above Section I. Emulsion grains and their preparation, Subsection E. Blends, layers and performance categories.

The emulsion layers as well as optional additional layers, such as overcoats and interlayers, contain processing solution permeable vehicles and vehicle modifying addenda. Typically these layer or layers contain a hydrophilic colloid, such as gelatin or a gelatin derivative, modified by the addition of a hardener. Illustrations of these types of materials are contained in *Research Disclosure,* Item 36544, previously cited, Section II. Vehicles, vehicle extenders, vehicle-like addenda and vehicle related addenda. The overcoat and other layers of the photographic element can usefully include an ultraviolet absorber, as illustrated by *Research Disclosure,* Item 36544, Section VI. UV dyes/optical brighteners/luminescent dyes, paragraph (1). The overcoat, when present can usefully contain matting agents to reduce surface adhesion. Surfactants are commonly added to the coated layers to facilitate coating. Plasticizers and lubricants are commonly added to facilitate the physical handling properties of the photographic elements. Antistatic agents are commonly added to reduce electrostatic discharge. Illustrations of surfactants, plasticizers, lubricants and matting agents are contained in *Research Disclosure,* Item 36544, previously cited, Section IX. Coating physical property modifying addenda.

Preferably the photographic elements of the invention include a conventional processing solution decolorizable antihalation layer, either coated between the emulsion layer (s) and the support or on the back side of the support. Such layers are illustrated by *Research Disclosure,* Item 36544, cited above, Section VIII. Absorbing and Scattering Materials, Subsection B, Absorbing materials and Subsection C. Discharge.

A specific preferred application of the invention is in color photographic elements, particularly color print (e.g., color paper) photographic elements intended to form multicolor images. In multicolor image forming photographic elements at least three superimposed emulsion layer units are coated on the support to separately record blue, green and red exposing radiation. The blue recording emulsion layer unit is typically constructed to provide a yellow dye image on processing, the green recording emulsion layer unit is typically constructed to provide a magenta dye image on processing, and the red recording emulsion layer unit is typically constructed to provide a cyan dye image on processing. Each emulsion layer unit can contain one, two, three or more separate emulsion layers sensitized to the same one of the blue, green and red regions of the spectrum. When more than one emulsion layer is present in the same emulsion layer unit, the emulsion layers typically differ in speed. Typically interlayers containing oxidized developing agent scavengers, such as ballasted hydroquinones or aminophenols, are interposed between the emulsion layer units to avoid color contamination. Ultraviolet absorbers are also commonly coated over the emulsion layer units or in the interlayers. Any convenient conventional sequence of emulsion layer units can be employed, with the following being the most typical:

| |
|---|
| Surface Overcoat |
| Ultraviolet Absorber |
| Red Recording Cyan Dye Image Forming Emulsion Layer Unit |
| Scavenger Interlayer |
| Ultraviolet Absorber |
| Green Recording Magenta Dye Image Forming Emulsion Layer Unit |
| Scavenger Interlayer |
| Blue Recording Yellow Dye Image Forming Emulsion Layer Unit |
| Reflective Support |

Further illustrations of this and other layers and layer arrangements in multicolor photographic elements are provided in *Research Disclosure,* Item 36544, cited above, Section XI. Layers and layer arrangements.

Each emulsion layer unit of the multicolor photographic elements contain a dye image forming compound. The dye image can be formed by the selective destruction, formation or physical removal of dyes. Element constructions that form images by the physical removal of preformed dyes are illustrated by *Research Disclosure,* Vol. 308, December 1989, Item 308119, Section VII. Color materials, paragraph H. Element constructions that form images by the destruction of dyes or dye precursors are illustrated by *Research Disclosure,* Item 36544, previously cited, Section X. Dye image formers and modifiers, Subsection A. Silver dye bleach. Dye-forming couplers are illustrated by *Research Disclosure,* Item 36544, previously cited, Section X. Subsection B. Image-dye-forming couplers. It is also contemplated to incorporate in the emulsion layer units dye image modifiers, dye hue modifiers and image dye stabilizers, illustrated by *Research Disclosure,* Item 36544, previously cited, Section X. Subsection C. Image dye modifiers and Subsection D. Hue modifiers/stabilization. The dyes, dye precursors, the above-noted related addenda and solvents (e.g., coupler solvents) can be incorporated in the emulsion layers as dispersions, as illustrated by *Research Disclosure,* Item 36544, previously cited, Section X. Subsection E. Dispersing and dyes and dye precursors.

A photographic element may comprise a support bearing at least one light sensitive silver halide emulsion layer comprising a dispersion of a dye-forming coupler and a water-insoluble polymer, wherein the polymer has a glass transition temperature of less than or equal to about 80° C. and is formed from at least 15 wt % monomer units which provide the polymer with functional groups that are hydrogen bond donors.

Materials useful in the preparation of color papers are further illustrated by current commercial practice as, for example, by EDGE™, PORTRA™ or SUPRA™, Color Papers as sold by Eastman Kodak Company, by FUJI™ FA-family Color Papers as sold by Fuji Photo Film, by KONICA™ QA-family Color Papers as sold by Konishiroku Industries, by DURATRANS™ and DURACLEAR™ display films as sold by Eastman Kodak Company and by KONSENSUS-II™ display films as sold by Konishiroku Industries. The advantages of the current invention may be achieved by modifying any of these formulations to conform to the requirements set forth in the specification. The exact magnitude of the benefits achieved will, of course, depend on the exact details of the formulations involved but these will be readily apparent to the skilled practitioner.

Additionally, the elements may comprise a substituted pyrazolotriazole or a substituted 3-aminopyrazolone magenta dye-forming image coupler which may be a four equivalent coupler but is preferably a two equivalent coupler. The term "equivalent" indicates the formal stoichiometric relationship between the number of moles of silver reduced per mole of image dye formed in a coupling reaction. The couplers and coupler mixtures described at U.S. Pat. Nos. 5,091,297; 5,270,153; 4,675,280; 4,755,455; 4,954,431; 5,110,718; 5,084,375; 4,600,688; 4,443,536; and 4,830,955 are additionally useful in the practice of this invention.

Couplers that may be used in the color photographic display elements of the invention can be defined as being 4-equivalent or 2-equivalent depending on the number of atoms of $Ag^+$ required to form one molecule of dye. It is generally preferred to use 2-equivalent couplers in color paper elements in the interest of reducing silver levels. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, heterooxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961).

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400.

Typical pyrazoloazole and pyrazolone couplers are represented by the following formulas:

MAGENTA-1

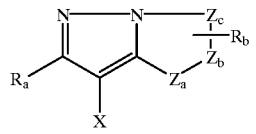

MAGENTA-2

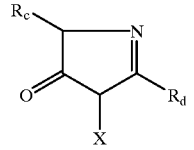

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

According to one embodiment, the yellow dye-forming coupler is an acylacetanilide compound. According to a second embodiment, the yellow dye-forming coupler is a pivaloylacetanilide compound.

Polymer containing coupler dispersions may be prepared by emulsifying a mixed oil solution comprising the polymer and the dye-forming coupler, as described, e.g., in U.S. Pat. Nos. 3,619,195 and 4,857,449.

In accordance with an embodiment, polymer-containing dispersions of dye-forming couplers may also be prepared as loaded latex dispersions. These may be prepared according to at least three types of processes. The first process, described in, e.g., U.S. Pat. No. 4,203,716, involves dissolving a hydrophobic photographically useful compound to be loaded in a volatile or water miscible auxiliary solvent, combining this solution with an aqueous solution containing a polymer latex, and diluting the dispersion with additional aqueous solution or evaporating the auxiliary solvent to cause loading to occur. A second, more preferred method for preparing loaded latex formulations is to subject an oil solution or an aqueous dispersion of an oil solution comprising photographically useful compounds, to conditions of high shear or turbulence, in the presence of a polymer latex, with sufficient shear to cause loading as described in concurrently filed, copending, commonly assigned U.S. Pat. No. 5,594,047, the disclosure of which is hereby incorporated by reference in its entirety. A third possible way to prepare some loaded latex formulations is to simply combine a polymer latex with a dispersed oil solution free of volatile organic solvent, such that the oil solution and latex are miscible, in the presence of surfactant, for a sufficient time before the dispersion is coated for loading to occur as described in concurrently filed, copending, commonly assigned U.S. Pat. No. 5,558,980, the disclosure of which is hereby incorporated by reference in its entirety.

Polymers used in these dispersions are sufficiently hydrophobic to be incorporated as components of the hydrophobic dispersed phase of the dispersions. The polymers may be prepared by bulk polymerization or solution polymerization processes. Especially preferred among possible polymerization processes is the free-radical polymerization of vinyl monomers in solution.

Preferred latex polymers include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex (e.g., copolymers may comprise limited amounts of ionic monomers (e.g., about 1–10 wt %), so long as the copolymer remains substantially water insoluble).

It is also contemplated that the emulsion composition of the invention may be advantageously incorporated into the elements described in an article titled "Typical and Preferred Color Paper, Color Negative, and Color Reversal Photographic Elements and Processing," published in *Research Disclosure,* February 1995, Item 37038.

Various types of hardeners are useful in conjunction with elements of the invention. In particular, bis(vinylsulfonyl) methane, bis(vinylsulfonyl) methyl ether, 1,2-bis (vinylsulfonyl-acetamido) ethane, 2,4-dichloro-6-hydroxy-s-triazine, triacryloyl-triazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

The invention may also be used in combination with photographic elements containing filter dye layers comprising colloidal silver sol or yellow, cyan, and/or magenta filter dyes, either as oil-in-water dispersions, latex dispersions or as solid particle dispersions. Additionally, they may be used with elements containing "smearing" couplers (e.g. as described in U.S. Pat. No. 4,366,237; EP 96,570; U.S. Pat. Nos. 4,420,556 and 4,543,323.)

It is specifically contemplated that the concepts of the present invention may be employed to obtain reflection color prints as described in *Research Disclosure,* November 1979, Item 18716 and *Research Disclosure* 37038, February 1995, incorporated herein by reference. Materials of the invention may be used in combination with a photographic element coated on pH adjusted support as described in U.S. Pat. No. 4,917,994; with a photographic element coated on support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171.

Color paper elements typically contain less than 0.80 $g/m^2$ of total silver. Due to the need to decrease the environmental impact of color paper processing, it is desired to decrease the amount of total silver used in the element as much as possible. Therefore, total silver levels of less than 0.65 $g/m^2$ are preferable, and levels of 0.55 $g/m^2$ are even more preferable. It is possible to reduce further the total silver used in the color paper photographic element to less than 0.10 $g/m^2$ by use of a so-called development application process whereby the incorporated silver is used only to form the latent image, while another oxidant, such as hydrogen peroxide, serves as the primary oxidant to react with the color developer. Such processes are well known to the art, and are described in, for example, U.S. Pat. Nos. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

The gold and sulfur are typically utilized with 0.1 to 200 mg gold per silver mole and 0.1 to 20 mg sulfur per silver mole. Preferred amounts of gold and sulfur are 0.5 to 150 mg gold per silver mole and 0.5 to 8 mg sulfur per Ag mole. The most preferred is colloidal gold sulfide at between 2 and 70 mg per 250 $m^2$ per silver halide emulsion grain surface area.

The disulfide compounds of this invention are represented by following formula:

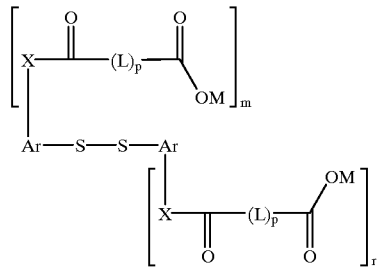

Ar is an aromatic group either of a single ring or a condensed ring, preferably having 6 to 10 carbon atoms and more preferably having 6 carbon atoms. Examples of suitable aromatic groups include naphthyl and phenyl. Ar may be further substituted or may be unsubstituted, more preferably Ar is unsubstituted. Examples of suitable substituents include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxyl groups, halogen atoms, aryloxy groups (for example, phenoxyl), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred are simple alkyl groups and acylamino groups.

X is independently an —O—, —NH— or —NR—. Most preferably X is —NH—. If X is —NR—, R is a substituent which does not interfere with the intended function of the disulfide compound in the photographic emulsion and which maintains the water soluability of the compound. Examples of suitable substituents include alkyl groups (for example, methyl, ethyl, hexyl), fluoroalkyl groups (for example, trifluoromethyl), aryl groups (for example, phenyl, naphthyl, tolyl), sulfonyl groups (for example, methylsulfonyl, phenylsulfonyl). Preferred are simple alkyl groups and simple fluoroalkyl groups.

r and m are independently 0, 1, or 2. Therefore, included are those compounds in which only one of the aromatic groups is substituted. Preferably m and r are both 1. X is independently in any position in the aromatic nucleus relative to the sulfur. More preferably, the molecule is symmetrical and preferably X is either in the para or ortho position.

L is a linking group. p is 0 or 1. Preferably L is a unsubstituted alkylene group and is usually —$(CH_2)_n$— where n ranges from zero to 11 and is preferably 1 to 3. Other examples of L are given below,

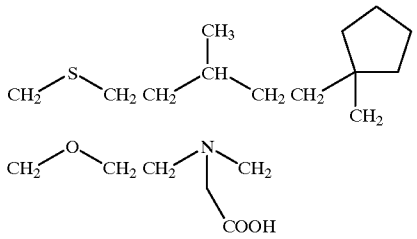

M is either a hydrogen atom or a cationic species if the carboxyl group is in its ionized form. The cationic species may be a metal ion or an organic ion. Examples of organic cations include ammonium ions (for example, ammonium, tetramethylammonium, tetrabutylammonium), phosphonium ions (for example, tetraphenylphosphonium), and guanidyl groups. Preferably M is hydrogen or an alkali metal cation, with a sodium or potassium ion being most preferred.

Examples of the disulfide compounds of this invention are shown below. Compounds I–A through I–H are preferred with Compounds I–D and I–E being most preferred.

I-A

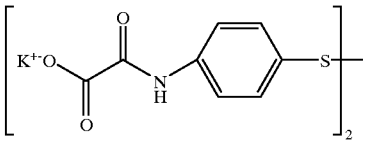

I-B

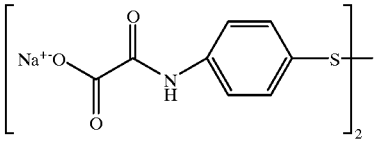

I-C

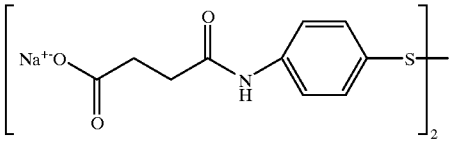

-continued

I-D

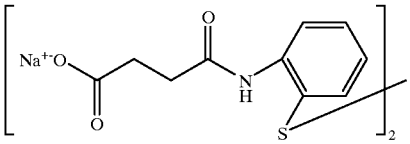

I-E

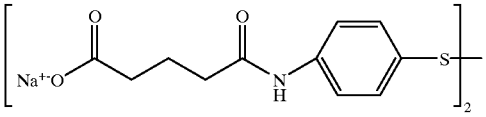

I-F

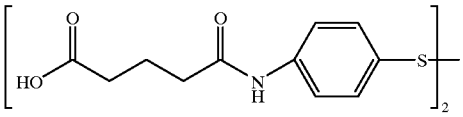

I-G

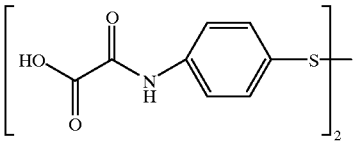

I-H

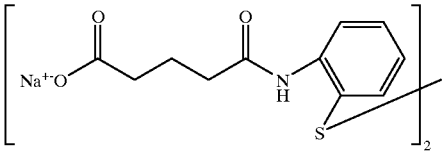

I-I

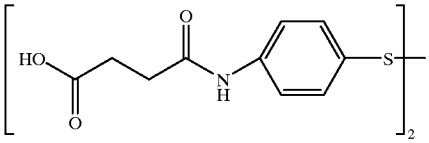

I-J

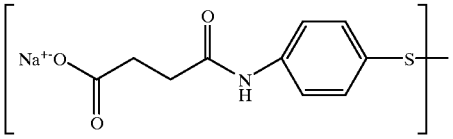

I-K

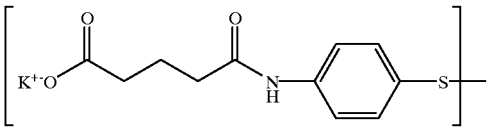

I-L

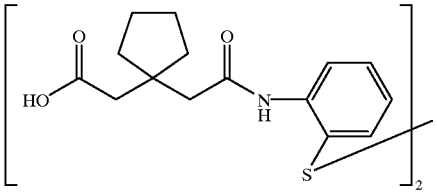

I-M

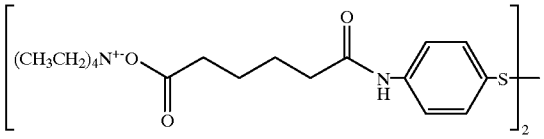

-continued

I-N

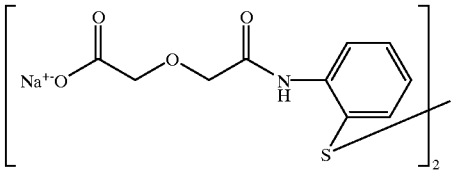

I-O

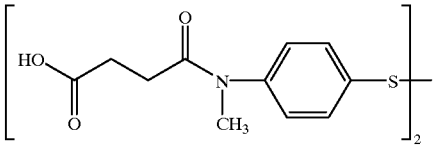

I-P

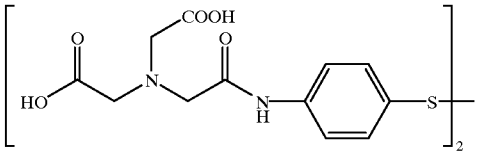

I-Q

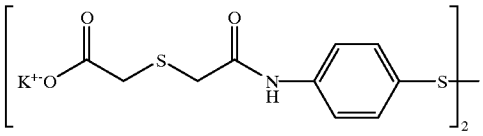

I-R

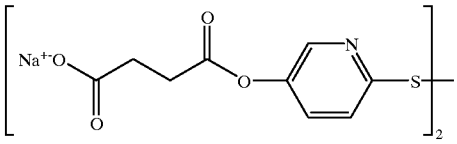

I-S

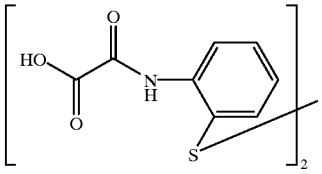

I-T

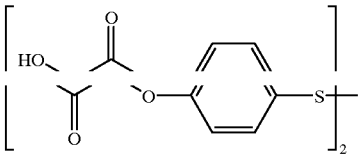

I-U

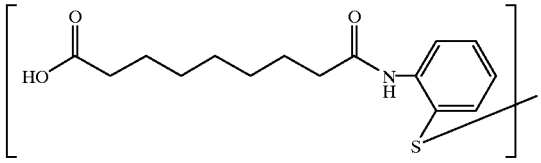

I-V

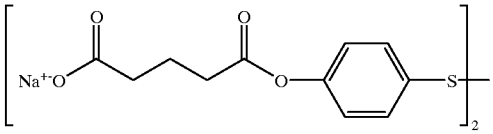

-continued

I-W

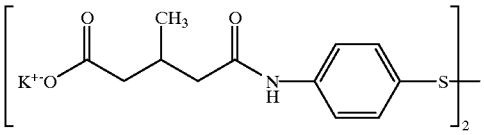

I-X

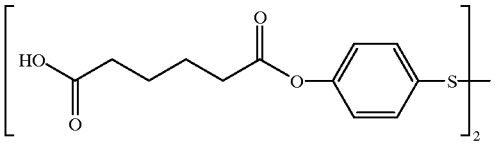

I-Y

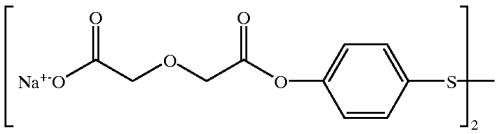

I-Z

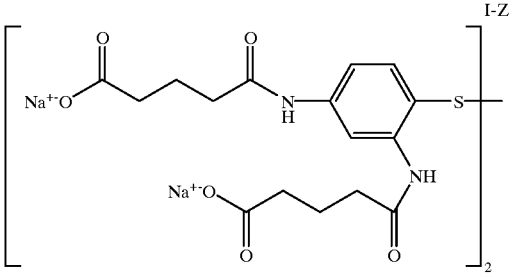

The solubilized disulfides of this invention are easily prepared using readily available starting materials. Most of the solubilized disulfides can be obtained by reacting aminophenyl disulfide or hydroxyphenyl disulfide with the appropriate cyclic anhydride followed by conversion of the free diacid to its anionic form using materials such as sodium bicarbonate. Other solubilized disulfides could be obtained by reacting aminophenyl disulfide or hydroxyphenyl disulfide with the mono chloride of a dicarboxylic acid mono ester, followed by hydrolysis of the ester to the carboxylic acid.

The disulfide compounds of the invention may be utilized in any suitable amount. Typical of amounts suitable for the invention is an amount between 0.1 and 500 mg/Ag mole. A preferred amount is between about 1 and about 100 mg/Ag mole. Most preferred is between 2–50 mg/Ag mole to provide best photographic speed with low fog.

The following examples illustrate the practice of this invention. They are not intended to be exhaustive of all possible variations of the invention. Parts and percentages are by weight unless otherwise indicated.

EXAMPLES

Photographic Performance Evaluation

Each of the multicolor, multilayer coatings was exposed by a 1700 Lux tungsten lamp with a 3000° K temperature for 0.5 seconds followed by processing in KODAK EKTACOLOR RA-4 processing chemistry in a roller transport processor. Filtration for the red sensitive layer was a Wratten 70, for the green sensitive layer a Wratten 99+0.3 neutral density, and for the blue Wratten 48+2B+0.8 neutral density. Emulsion coating performance was judged by measuring (a) photographic speed in relative Log exposure units at a density of 0.8, (b) a lower scale "toe" density at 0.2 Log E lower exposure than the speed point.

The fog is a measurement of the density of the processed coating in the area without exposure. In making practical products, it is useful for the propensity of the fog to not greatly increase with perturbations in manufacturing such as variability in chemical sensitization temperature. For the purposes of this work, the fog was considered "good" if the fog increase was measured at less than +0.01 density for an optimum chemical sensitization and if the increase measured less than +0.02 when the chemical sensitization temperature was increased 10° C., e.g., 65° C. vs. 55° C. for the optimum chemical sensitization. If either one of these conditions was not met, the fog result was judged as "poor".

The "Contrast LIRF" is the Low Intensity Contrast Reciprocity Failure and was measured by comparing the Toe from a 0.5 sec. exposure to the Toe at 128 sec. The difference of the Toe at 128 sec. minus the Toe at 0.5 sec. is the measurement that was used for "Contrast LIRF". Changes in contrast can affect picture quality. The exposure time can depend considerably on the printing equipment and the print size. Generally speaking, the larger the print, the longer the exposure time. There are printers for smaller print sizes that have exposure times of less than 0.5 sec. For these situations, an exposure time of 0.031 sec. was used. These shorter time have higher lamp intensity. The "Contrast HIRF" which is High Intensity Contrast Reciprocity Failure is the difference of the Toe at 0.031 sec. minus the Toe at 0.5 sec. If there were no contrast reciprocity failure, both the "Contrast LIRF" and the "Contrast HIRF" would equal zero. In this analysis a change of less than 0.02 was considered "good" and a change equal to or greater than 0.02 was considered "poor" for the "Contrast LIRF" and for the "Contrast HIRF" measurement.

Heat Sensitivity is a measure of the effect temperature at the time of printing. The speed can increase or decrease as a function of increased temperature. In a practical printing situation this can result in a change in picture density and color and can contribute to color variability in pictures. "Heat Sensitivity" was measured as the difference of speed of paper between 100° F. and 60° F. for all records, cyan, magenta, and yellow, and the "Heat Sensitivity" was considered "unacceptable" if the difference between the record being changed (comparisons and invention) and either of the other two records was greater than 0.03 Log E in color balance. A color balance of 0.03 or less over the 100–60° F. change was considered "acceptable".

Wet Abrasion Sensitivity Measurement

Photographic elements Sample 1–5 were exposed and processed through KODAK EKTACOLOR RA-4 processing chemistry. Approximately 10 seconds into the developer, an increasing amount of mass was applied to a 0.063 inch diameter stylus that was run over the emulsion side of the sample. The amount of weight used was 6 to 30 grams. The paper was examined for a visible mark. When the paper showed a mark at all weights, it was determined to show a "bad" result. When no marks were observed, the result was "good".

Preparation of Sample 1

Yellow emulsion YE1 was prepared by adding approximately equimolar silver nitrate and sodium chloride solutions into a well-stirred reactor containing gelatin peptizer and thioether ripener. Cesium pentachloronitrosylosmate was added from 5% to 70% of the making process, and potassium iodide was added at 93% of the making process to form a band of silver iodide in the grain. The resultant emulsion contained cubic shaped grains of 0.60 μm in edge length size. This emulsion was optimally sensitized by the addition of glutarydiaminophenylsulfide followed by the addition of a colloidal suspension of aurous sulfide and heat ramped to 60° C. during which time blue sensitizing dye, Dye 1, potassium hexachloroiridate, Lippmann bromide, and 1-(3-acetamidophenyl)-5-mercaptotetrazole were added.

Magenta emulsion ME1 was precipitated by adding approximately equimolar silver nitrate and sodium chloride solutions into a well-stirred reactor containing gelatin peptizer and thioether ripener. The resultant emulsion contained cubic shaped grains of 0.30 μm in edge length size. This emulsion was optimally sensitized by the addition of a colloidal suspension of aurous sulfide and heated to 55° C. The following were then added: potassium hexachloroiridate, Lippmann bromide, and green sensitizing dye, Dye 2. The finished emulsion was then allowed to cool, and 1-(3-acetamidophenyl)-5-mercaptotetrazole was added a few seconds after the cool down began.

Cyan emulsion CE1 was precipitated by adding approximately equimolar silver nitrate and sodium chloride solutions into a well-stirred reactor containing gelatin peptizer and thioether ripener. The resultant emulsion contained cubic shaped grains of 0.40 μm in edge length size. This emulsion was optimally sensitized by the addition of Bis(1,4,5-trimethyl-1,2,4-triazolium-3-thiolate)gold(I) fluoroborate and sodium thiosulfate followed by heat digestion at 65° C. The following were then added: 1-(3-acetamidophenyl)-5-mercaptotetrazole, potassium hexachloroiridate, and potassium bromide. The emulsion was cooled to 40° C., and the red sensitizing dye, Dye 3, was added.

Emulsions YE1, ME1, and CE1 were combined with coupler-bearing dispersions by techniques known in the art and applied to polyethylene coated paper base according to the structure shown in Format 1 to prepare Sample 1.

Sample 1 was measured for Contrast LIRF, Contrast HIRF, Heat Sensitivity, Fog and Wet Abrasion Sensitivity, as described earlier. The measurements are summarized in the Results Table. Sample 1 was free of yellow wet abrasion marks but showed magenta wet abrasion marks, and hence, Sample 1 was judged poor for wet abrasion.

Preparation of Sample 2

Sample 2 was prepared as Sample 1 with the exception that magenta emulsion ME2 was used in place of ME1. ME2 was prepared as YE1 by adding approximately equimolar silver nitrate and sodium chloride solutions into a well-stirred reactor containing gelatin peptizer and thioether ripener. Cesium pentachloronitrosylosmate was added from 5% to 70% of the making process, and potassium-iodide was added at 93% of the making process to form a band of silver iodide in the grain. The resultant emulsion contained cubic shaped grains of 0.60 μm in edge length size. This emulsion was optimally sensitized by the addition of a colloidal suspension of aurous sulfide and heat ramped to 60° C. during which time blue sensitizing dye, Dye 1, potassium hexachloroiridate, Lippmann bromide, and 1-(3-acetamidophenyl)-5-mercaptotetrazole were added. Sample 2 was measured as Sample 1 for Contrast LIRF, Contrast HIRF, Heat Sensitivity, Fog and Wet Abrasion Sensitivity, as described earlier. The measurements are summarized in the Results Table. Sample 2 was free of yellow wet abrasion marks but continued to show magenta wet abrasion marks even when essentially the same emulsion was used in both the yellow and magenta dye-forming layers. Therefore, the wet abrasion of Sample 2 was judged poor.

Preparation of Sample 3

Sample 3 was prepared as Sample 1 except that magenta emulsion ME3 was used in place of ME1. ME3 was precipitated by adding approximately equimolar silver nitrate and sodium chloride solutions into a well-stirred reactor containing gelatin peptizer and thioether ripener. Cesium pentachloronitrosylosmate was added from 5% to 70% of the making process, and potassium iodide was added at 93% of the making process to form a band of silver iodide in the grain. The resultant emulsion contained cubic shaped grains of 0.22 mm in edge length size. A smaller grain size was chosen to adjust the speed to the desired response. This emulsion was optimally sensitized by the addition of glutaryldiaminophenyldisulfide, A1, followed by the addition of a colloidal suspension of aurous sulfide and heat ramped to 55° C. during which time green sensitizing dye, Dye 2, potassium hexachloroiridate, Lippmann bromide, and 1-(3-acetamidophenyl)-5-mercaptotetrazole were added. The 1-phenyl-5-mercaptotetrazole and 1-(3-acetamidophenyl)-5-mercaptotetrazole levels were reduced by half from levels of Sample 1. Sample 3 was measured as Sample 1 for Contrast LIRF, Contrast HIRF, Heat Sensitivity, Fog and Wet Abrasion Sensitivity, as described earlier. The measurements are summarized in the Results Table.

Preparation of Sample 4

Sample 4 was prepared as Sample 3 except that magenta emulsion ME4 was used in place of ME3. ME4 was prepared as ME3 except that increased levels of colloidal aurous sulfide were used. Sample 4 was measured as Sample 1 for Contrast LIRF, Contrast HIRF, and Heat Sensitivity.

Preparation of Sample 5

Sample 5 was prepared as Sample 4 except that magenta emulsion ME5 was used in place of ME4. ME5 was precipitated by adding approximately equimolar silver nitrate and sodium chloride solutions into a well-stirred reactor containing gelatin peptizer and thioether ripener. Cesium pentachloronitrosylosmate was added from 5% to 70% of the making process, and potassium iodide was added at 93% of the making process to form a band of silver iodide in the grain. Further, $K_2IrCl_5$(thiazole) was added from 95–97% of the making process. The resultant emulsion contained cubic shaped grains of 0.218 mm in edge length size. This emulsion was optimally sensitized by the addition of glutaryldiaminophenyldisulfide, A1, followed by the addition of a colloidal suspension of aurous sulfide at 6 times the level of ME1 and heat ramped to 55° C. during which time green sensitizing dye, Dye 2, potassium hexachloroiridate, Lippmann bromide, and 1-(3-acetamidophenyl)-5-mercaptotetrazole were added. Sample 5 was measured as Sample 1 for Contrast LIRF, Contrast HIRF, Heat Sensitivity, Fog and Wet Abrasion Sensitivity, as described earlier. The measurements are summarized in the Results Table.

Preparation of Sample 6

This sample was prepared as in Sample 3 except the green sensitive layer had the following composition:

| | Laydown mg/ft$^2$ |
|---|---|
| Gelatin | 117 |
| Magenta emulsion | 14 |
| M-2 | 27 |
| S-2 | 15 |
| ST2 | 3 |
| ST3 | 20 |
| ST4 | 54 |

-continued

M2

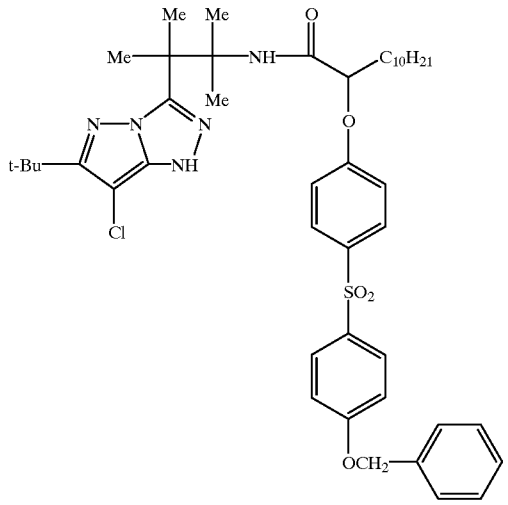

TABLE 1

Results

| Sample | Contrast LIRF | Contrast HIRF | Heat Sensitivity | Fog | Wet Abrasion Signal |
|---|---|---|---|---|---|
| 1 | poor | good | acceptable | acceptable | poor |
| 2 | poor | good | acceptable | poor | poor |
| 3 | poor | good | unacceptable | acceptable | good |
| 4 | good | poor | acceptable | acceptable | good |
| 5 | good | good | acceptable | acceptable | good |
| 6 | good | good | acceptable | acceptable | good |

As shown in Table 1, Samples 5 and 6 show good wet abrasion results while maintaining acceptable fog and heat sensitivity values without degrading reciprocity features.

Format 1

| | Item Description | Laydown mg/ft$^2$ |
|---|---|---|
| Layer 1 | Blue Sensitive Layer | |
| | Gelatin | 122 |
| | Yellow emulsion YE1 (as Ag) | 24 |
| | Y-1 | 45 |
| | ST-1 | 45 |
| | S-1 | 20 |
| Layer 2 | Interlayer | |
| | Gelatin | 70 |
| | SC-1 | 6 |
| | S-1 | 17 |
| Layer 3 | Green Sensitive Layer | |
| | Gelatin | 117 |
| | Magenta emulsion (as Ag) | 7 |
| | M-1 | 29 |
| | S-1 | 8 |
| | S-2 | 3 |
| | ST-2 | 2 |
| | ST-3 | 17.7 |
| | ST-4 | 57 |
| | PMT | 0.1 |
| Layer 4 | UV Interlayer | |
| | Gelatin | 68.4 |
| | UV-1 | 3 |

-continued
Format 1
| | Item Description | Laydown mg/ft$^2$ |
|---|---|---|
| | UV-2 | 17 |
| | SC-1 | 5.13 |
| | S-1 | 3 |
| | S-2 | 3 |
| Layer 5 | Red Sensitive Layer | |
| | Gelatin | 126 |
| | Cyan emulsion CE1 | 17 |
| | C-1 | 39 |
| | S-1 | 39 |
| | UV-2 | 25 |
| | S-2 | 3 |
| | SC-1 | 0.3 |
-continued
Format 1
| | Item Description | Laydown mg/ft$^2$ |
|---|---|---|
| Layer 6 | UV Overcoat | |
| | Gelatin | 48 |
| | UV-1 | 2 |
| | UV-2 | 12 |
| | SC-1 | 4 |
| | S-1 | 2 |
| | S-3 | 2 |
| Layer 7 | SOC | |
| | Gelatin | 60 |
| | SC-1 | 2 |
| | L-1 | 2 |
APPENDIX
Y-1
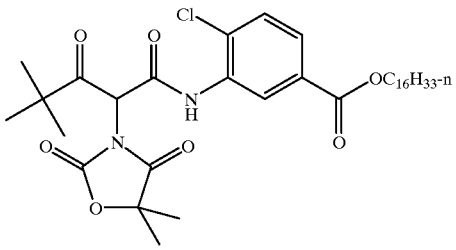
ST-1 = N-tert-butylacrylamide/n-butyl acrylate copolymer (50:50)
S-1 = dibutyl phthalate
SC-1
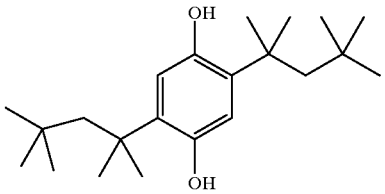
M-1
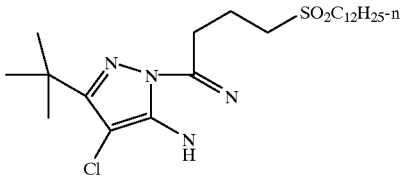
S-2 = diundecyl phthalate
ST-2
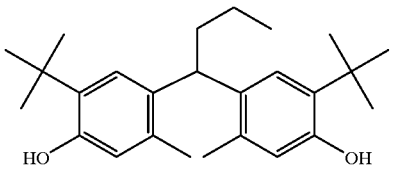

APPENDIX-continued
ST-3
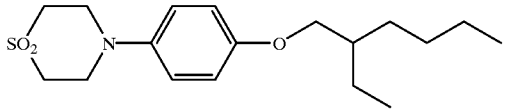
PMT = 1-phenyl-5-mercaptotetrazole
ST-4
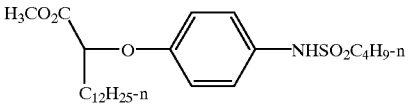
UV-1
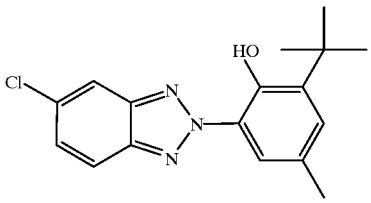
UV-2
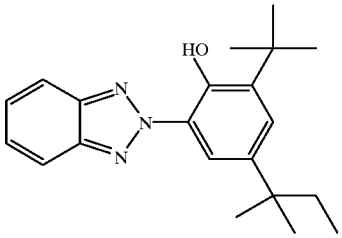
S-3 = 1,4-Cyclohexyldimethylene bis(2-ethylhexanoate)
C-1
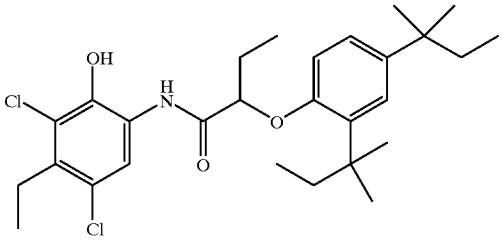
S-4 = 2-(2-Butoxyethoxy)ethyl acetate
Dye 1
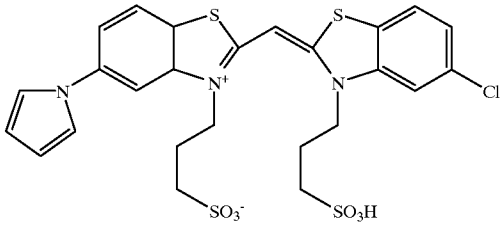
Dye 2
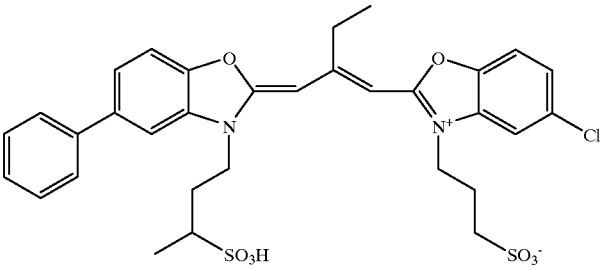

APPENDIX-continued

Dye 3

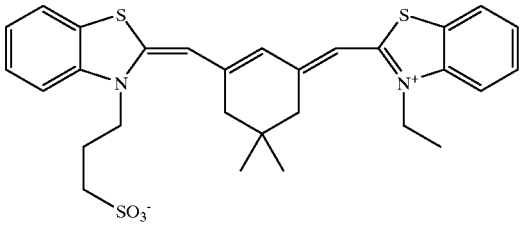

The invention has been described in detail with particular reference to preferred embodiments thereof, but it will be understood that variations and modifications can be effected within the spirit and scope of the invention.

What is claimed is:

1. A photographic emulsion comprising silver iodochloride grains, said grains further comprising iridium, said grains chemically sensitized with gold in an amount of between 0.1 and 200 mg gold per silver mole and sulfur in an amount between 0.1 and 20 mg sulfur per silver mole, 1-(3-acetamidophenyl)-5-mercaptotetrazole, 1-phenyl-5-mercaptotetrazole, and a disulfide compound represented by the following formula

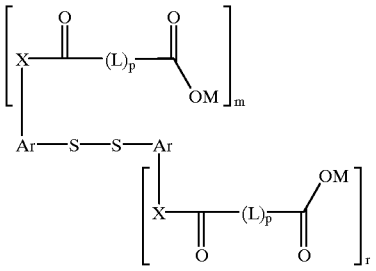

wherein

X is independently —O—, —NH— or —NR—, where R is a substituent;

m and r are independently 0, 1 or 2;

M is —H or a cationic species;

Ar is an aromatic group; and

L is a linking group, where p is 0 or 1.

2. The emulsion of claim 1 wherein said iridium comprises an iridium hexacoordination complex.

3. The emulsion of claim 1 wherein said iridium is selected from the group consisting of $K_2IrCl_5$(5-methylthiazole), $K_2IrBr_5$(thiazole), $KIrBr_4(thiazole)_2$, and $K_2IrCl_5$(thiazole).

4. The emulsion of claim 1 wherein said iridium compound comprises $K_2IrCl_5$(thiazole).

5. The emulsion of claim 1 wherein said gold is present in an amount between 0.5 and 150 mg/Ag mole.

6. The emulsion of claim 1 wherein said sulfur is present in an amount between 0.5 and 8 mg/Ag mole.

7. The emulsion of claim 1 wherein the silver iodochloride grains are partially bounded by {100} crystal faces satisfying the relative orientation and spacing of cubic grains and contain from 1.0 to 1.5 mole percent iodide, based on total silver, with maximum iodide concentrations located nearer the surface of the grains than their center.

8. The photographic emulsion of claim 1 where in said disulfide compound m and r are 1; Ar is an aromatic group having 6 to 10 carbon atoms; p is 1; and L is —$(CH_2)_n$—, where n is zero to 11.

9. The photographic emulsion of claim 1 where in said disulfide compound Ar is an aromatic ring having 6 carbon atoms; L is —$(CH_2)_n$—, where n is 1 to 3; and M is —H— or an alkali metal cation.

10. The photographic emulsion of claim 1 where in said disulfide compound X is —NH—.

11. The photographic emulsion of claim 1 wherein said photographic emulsion is greater than 50 mole % silver chloride.

12. The photographic emulsion of claim 1 wherein said photographic emulsion is greater than 95 mole % silver chloride.

13. The photographic emulsion of claim 1 wherein said grains further comprise osmium.

14. The photographic emulsion of claim 12 wherein said iridium is present in an amount between $1\times10^{-9}$ and $1\times10^{-5}$ mole/silver mole.

15. The emulsion of claim 1 wherein the silver iodochloride grains of said emulsion are comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide-free surface shell having a thickness of greater than 50 Å, and a sub-surface shell that contains a maximum iodide concentration.

16. The emulsion of claim 15 wherein the grain size coefficient of variation of the silver iodochloride grains is less than 35 percent.

17. The emulsion of claim 15 wherein the core contains at least 85 percent of total silver.

18. The emulsion of claim 15 wherein iodide forming the grains is excluded from the core of the grains.

19. The emulsion of claim 1 wherein said 1-(3-acetamidophenyl)-5-mercaptotetrazole is present in an amount between $1.5\times10^{-5}$ and $7.0\times10^{-5}$ mole/silver mole.

20. The emulsion of claim 1 wherein said 1-(phenyl-5-mercaptotetrazole is present in an amount between 0.01 and 0.07 mg/$ft^2$.

21. A photographic element comprising a photographic emulsion comprising silver iodochloride grains, said grains further comprising iridium, said grains chemically sensitized with gold in an amount of between 0.1 and 120 mg gold per silver mole and sulfur in an amount between 0.1 and 20 mg sulfur per silver mole, 1-(3-acetamidophenyl)-5-mercaptotetrazole, 1-phenyl-5-mercaptotetrazole, and a disulfide compound represented by the following formula:

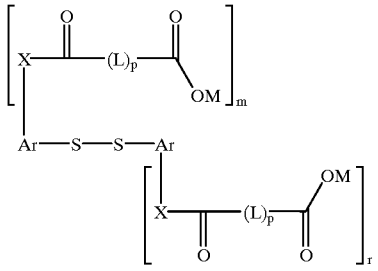

wherein

X is independently —O—, —NH— or —NR—, where R is a substituent;

m and r are independently 0, 1 or 2;

M is —H or a cationic species;

Ar is an aromatic group; and

L is a linking group, where p is 0 or 1.

22. A photographic element of claim 21 wherein said 1-(3-acetamidophenyl)-5-mercaptotetrazole is present in an amount between $5\times10^{-5}$ and $7\times10^{-5}$ mole/silver mole.

23. A photographic element of claim 21 wherein said photographic element comprises a green sensitive layer, said green sensitive layer comprising a pyrazoloazole coupler.

24. A photographic element of claim 23 wherein said pyrazoloazole coupler comprises a coupler of

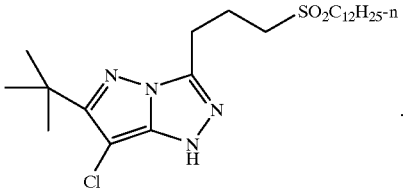

25. A photographic element of claim 21 wherein the silver iodochloride grains of said emulsion are comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide-free surface shell having a thickness of greater than 50 Å, and a sub-surface shell that contains a maximum iodide concentration.

26. A photographic element of claim 25 wherein the grain size coefficient of variation of the silver iodochloride grains is less than 35 percent.

27. A photographic element of claim 25 wherein iodide forming the grains is excluded from the core of the grains.

28. A photographic element of claim 25 wherein the core accounts for at least 85 percent of total silver forming the grains.

29. A photographic element of claim 21 wherein said 1-phenyl-5-mercaptotetrazole is present in an amount between 0.01 and 0.7 mg/ft$^2$.

30. The element of claim 22 wherein said element comprises an acylacetanilide compound as a yellow dye-forming coupler.

31. The element of claim 22 wherein said element comprises a pivaloylacetanilide compound as a yellow dye-forming coupler.

32. The photographic element of claim 22 wherein said iridium is present in an amount between $1\times10^{-9}$ and $1\times10^{-5}$ mole/silver mole.

33. A photographic element of claim 23 wherein said pyrazoloazole coupler comprises

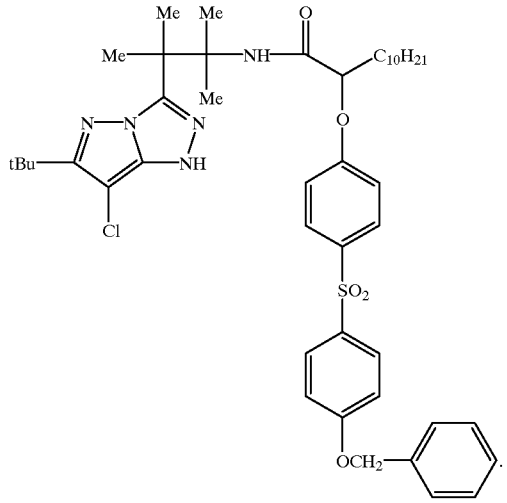

* * * * *